US008480383B2

(12) United States Patent
Fukano et al.

(10) Patent No.: US 8,480,383 B2
(45) Date of Patent: Jul. 9, 2013

(54) SOLENOID PUMP

(75) Inventors: Yoshihiro Fukano, Moriya (JP); Takamitsu Suzuki, Joso (JP)

(73) Assignee: SMC Kabushiki Kaisha, Tokyo (JP)

( * ) Notice: Subject to any disclaimer, the term of this patent is extended or adjusted under 35 U.S.C. 154(b) by 138 days.

(21) Appl. No.: 13/105,295

(22) Filed: May 11, 2011

(65) Prior Publication Data

US 2012/0107155 A1 May 3, 2012

(30) Foreign Application Priority Data

Oct. 28, 2010 (JP) ..... 2010-242354

(51) Int. Cl.
*F04B 17/00* (2006.01)

(52) U.S. Cl.
USPC ..... 417/413.1; 417/412; 417/417

(58) Field of Classification Search
USPC ..... 417/412, 413.1, 415, 416, 417, 569
See application file for complete search history.

(56) References Cited

U.S. PATENT DOCUMENTS 3,701,614 A * 10/1972 Guidicelli ..... 417/413.1
4,832,582 A * 5/1989 Buffet ..... 417/413.1
4,874,299 A * 10/1989 Lopez et al. ..... 417/413.1
5,284,425 A 2/1994 Holtermann et al.
6,568,926 B1 * 5/2003 Mount ..... 417/568
7,981,083 B2 * 7/2011 Rochat ..... 604/151

FOREIGN PATENT DOCUMENTS

| | | |
|---|---|---|
| JP | 55-137261 | 9/1980 |
| JP | 56-15474 | 2/1981 |
| JP | 61-076775 | 4/1986 |
| JP | 2004-143960 | 5/2004 |
| JP | 2007-504396 | 3/2007 |

OTHER PUBLICATIONS

Japanese Office Action (2010-242354) dated Dec. 18, 2012 (w/partial English translation).

* cited by examiner

*Primary Examiner* — Peter J Bertheaud
(74) *Attorney, Agent, or Firm* — Oblon, Spivak, McClelland, Maier & Neustadt, L.L.P.

(57) ABSTRACT

A solenoid pump is equipped with a housing formed therein with a fluid passage through which a fluid flows from an inlet port to an outlet port, and a movable member, which is displaced based on an excitation state of a solenoid section, for thereby opening and closing the fluid passage. The fluid passage includes an inlet side passage that communicates with the inlet port, an outlet side passage that communicates with the outlet port, and a pump chamber made up of a space in communication with the inlet side passage and the outlet side passage, and surrounded by the housing and an end portion of the movable member. Accompanying displacement thereof, the movable member opens and closes communication between the pump chamber and the outlet side passage.

9 Claims, 6 Drawing Sheets

SOLENOID PUMP

CROSS-REFERENCE TO RELATED APPLICATION

This application is based upon and claims the benefit of priority from Japanese Patent Application No. 2010-242354 filed on Oct. 28, 2010, of which the contents are incorporated herein by reference.

BACKGROUND OF THE INVENTION

1. Field of the Invention

The present invention relates to a solenoid pump having a movable member, which is displaced by excitation of a solenoid section, wherein opened and closed states of a fluid passage are switched by displacement of the movable member.

2. Description of the Related Art

Heretofore, in the fields of chemistry and medicine, with the aim of analyzing the components included in liquids, or for mixing multiple liquids at predetermined proportional amounts or the like, liquid supply apparatus have been used, which are capable of supplying liquids in fine amounts. Such apparatus are equipped with a solenoid pump that causes fine amounts of liquid to be drawn in and delivered out, and are constituted so as to control the supply of such liquids at a desired amount.

As one such solenoid pump, there can be cited the fluid pump (fluid metering pump) disclosed in U.S. Pat. No. 5,284,425. In the disclosed fluid pump, by sliding movement of a movable member (plunger) due to excitation of a solenoid assembly, the movable member releases and opens an opening of an inlet side passage (inlet flow passage), which is normally blocked by the movable member, thereby placing the inlet side passage in communication with a pump chamber. More specifically, in the fluid pump of U.S. Pat. No. 5,284,425, accompanying a releasing action of the movable member, a desired amount of fluid (liquid) is drawn into the pump chamber from an upstream side fluid passage, and accompanying a blocking action of the movable member, the predetermined amount of fluid is caused to flow out from the pump chamber.

However, with the fluid pump of U.S. Pat. No. 5,284,425, the problems enumerated below are known to occur as a result of the movable member opening and closing the state of communication between the inlet side passage and the pump chamber.

First, from closing (blocking) of the inlet side passage through which fluid is drawn in by the movable member, because at this time the pump chamber remains in an open state of communication with the outlet side passage, it is easy for fluid that remains stored in the pump chamber and/or the outlet side passage to become contaminated. In particular, in the case that the fluid is a liquid, moisture tends to be removed from the interior of the pump chamber and via the outlet side passage, which leads to a concern that the liquid may become solidified. Also, in this case, disadvantages occur in that the amount of liquid that is drawn into the pump chamber tends to change, or undue time and labor must be expended when the interior of the pump chamber is cleaned, for example, when maintenance is performed thereon.

Secondly, because the discharged fluid is retained in a space made up of a comparatively large volume formed by the pump chamber and the outlet side passage, at a time when the movable member blocks the inlet side passage, a large amount of fluid is pushed out, which tends to cause large variations in the timing up to completion of outward flowing of the fluid (also referred to as liquid cut off, in the case that the fluid is a liquid). As a result, the amount of fluid that flows out from the outlet side passage is unstable.

Thirdly, in a state where the movable member blocks the inlet side passage, a membrane portion of the diaphragm that directly blocks the inlet side passage experiences changes and becomes warped over time, such that the volume of the pump chamber also undergoes changes. As a consequence, the fluid that flows into the pump chamber may be pushed out unexpectedly into the outlet side passage, causing leakage of the fluid to occur.

SUMMARY OF THE INVENTION

The present invention has been devised as a solution to the aforementioned problems, and has the object of providing a solenoid pump in which a communication state of a fluid passage through which a fluid flows can easily be switched, such that the amount of fluid flowing through the fluid passage can be controlled with high precision. In addition, deterioration of the fluid in the interior of the fluid passage can be prevented, the amount of fluid that flows out from the outlet side passage can be kept stable, and leakage of fluid can be prevented.

To achieve the above objects, the present invention is characterized by a solenoid pump having a housing formed therein with a fluid passage through which a fluid flows from an inlet port to an outlet port, and a movable member, which is displaced based on an excitation state of a solenoid section, for thereby opening and closing the fluid passage, wherein the fluid passage includes an inlet side passage that communicates with the inlet port, an outlet side passage that communicates with the outlet port, and a pump chamber made up of a space in communication with the inlet side passage and the outlet side passage, and surrounded by the housing and an end portion of the movable member, and wherein the movable member, accompanying displacement thereof, opens and closes communication between the pump chamber and the outlet side passage.

According to the above, because the movable member is constituted so as to enable opening and closing of the communication state between the pump chamber and the outlet side passage, the pump chamber and the outlet side passage can reliably be blocked off from one another. More specifically, in the solenoid pump, fluid that resides in the interior of the pump chamber is not exposed to the outlet side passage. Consequently, even if the outlet side passage is placed in an opened state, the fluid in the pump chamber does not become deteriorated, and the amount of deteriorated fluid can be reduced. Further, in the case that the fluid is a liquid, solidification of the liquid caused by exposure of the liquid can be suppressed, and the volume of liquid inside the pump chamber can be kept stable. Owing thereto, the solenoid pump can keep the amount of liquid that is drawn into the pump chamber constant, and is capable of supplying a desired amount of liquid with high precision. Additionally, by suppressing solidification of the liquid, maintenance operations such as cleaning or the like can be performed more easily.

Further, by constructing the movable member so as to block communication between the pump chamber and the outlet side passage, when the movable member blocks the fluid passage, fluid can be reliably blocked from flowing out, as described above. Owing thereto, when the fluid passage is blocked by the movable member, the timing at which outward flowing of fluid is stopped can be stabilized, and a desired amount of fluid can be stably discharged from the outlet side passage.

In addition, as a further detailed structure of the solenoid pump, the housing is formed by a fixed wall that surrounds an opening of the outlet side passage in communication with the pump chamber, a diaphragm is provided on the end portion of the movable member, wherein the diaphragm is formed with an abutment, which confronts the fixed wall, and an outer peripheral edge portion of the diaphragm is fixed to the housing, wherein the abutment is placed in intimate contact with the fixed wall during a blocked condition of the fluid passage.

In this manner, during a closed condition of the fluid passage, as a result of the abutment of the diaphragm coming into intimate contact with the fixed wall of the housing, communication between the pump chamber and the outlet side passage can be blocked more reliably. Further, even if the membrane of the diaphragm changes over time and becomes warped, because the movable member blocks the outlet side passage, fluid flowing into the pump chamber is not pushed out from the pump chamber, and leakage of fluid can reliably be prevented.

In this case, preferably, the fixed wall and the abutment are formed with flat shapes. By forming the fixed wall in a flat shape, no parts thereon exist that act to obstruct flowing of the fluid toward the outlet side passage, and thus compared to, for example, a structure in which a projection to facilitate sealing is formed surrounding the opening portion, fluid that flows into the pump chamber can smoothly be guided into the outlet side passage. Furthermore, because the abutment that confronts the fixed wall also is formed in a flat shape, in a state in which the fluid passage is blocked, the fixed wall and the projection can be kept in close intimate contact with each other more strongly.

Further, the diaphragm may include a membrane portion, which possesses an elastic force, and is connected between the abutment and the outer peripheral edge portion. The movable member may further comprise a support member that supports a surface of the membrane portion on an opposite side from a surface thereof that faces toward the pump chamber.

At a time when the movable member blocks the fluid passage, even in the case that a pressing force is imparted to the diaphragm from the fluid, the membrane portion is easily supported and deformation of the membrane portion can be avoided. Owing thereto, the fluid passage can be blocked while the shape and form of the diaphragm is maintained, even as a pressing force of the fluid is imparted to the diaphragm, whereby a desired amount of fluid can stably be discharged into the outlet side passage.

In this case, preferably, in a condition in which the fluid passage is blocked by the diaphragm, the support member is formed in a tapered shape along an inclination of the opposite side surface. In this manner, by being formed in a tapered shape along an inclination of the surface of the membrane portion on a side opposite from the surface thereof that faces the pump chamber, the support member is capable of reliably supporting the membrane portion without applying large loads thereto tending to elastically deform the membrane portion.

In addition, the diaphragm may include an attachment portion that is attached to the end portion of the movable member, and the support member may be formed in an annular shape and may be mounted in surrounding fashion to a side peripheral surface of the attachment portion. Owing thereto, because the support member can provide support across the entire surface of the opposite side of the membrane portion, the membrane portion can be supported more reliably. In addition, owing to the attachment portion of the diaphragm being surrounded by the annular-shaped support member, a structure is provided in which detachment or dropping off of the movable member from the diaphragm can be deterred.

Further, the opening of the outlet side passage may be formed in a tapered shape expanding in diameter toward the movable member, and the diaphragm may be formed with a projection, which engages with the tapered shape of the opening of the outlet side passage.

By forming the opening of the outlet side passage in a tapered shape, the fluid in the interior of the pump chamber can be guided more easily to the outlet side passage. Further, by engagement of the projection of the diaphragm in the opening of the outlet side passage, the opening of the outlet side passage can be easily and tightly sealed, so that the communication state of the fluid passage can be blocked more reliably.

Furthermore, a check valve may be disposed in the inlet side passage, which enables the fluid to flow from the inlet port into the pump chamber, while blocking flow of the fluid from the pump chamber into the inlet port. The diaphragm may comprise an engagement portion confronting a valve tip part of the check valve, and the valve tip part may be blocked by the engagement portion in the condition in which the fluid passage is blocked by the diaphragm.

In this manner, by blocking the valve tip part of the inlet side check valve using the engagement portion, even in the case of a pressure force, such as a surge pressure or the like of fluid from the inlet side passage into which the fluid flows, the pressure force in the valve tip part of the inlet side check valve can be prevented. As a result, the pressure force does not reach the pump chamber or the diaphragm, and therefore, for example, assuming a structure in which the fluid passage is blocked by pressing the movable member using a pressing spring, a spring having a small pressing force can be applied. In addition, by application of a spring having the small pressing force, it becomes possible to suppress the force (thrust) needed to cause displacement of the movable member accompanying excitation of the solenoid section, whereby the apparatus can be miniaturized by using a small scale solenoid with a small number of coil windings.

In this case, the engagement portion may be formed integrally with the diaphragm. In this manner, by making the engagement portion integral with the diaphragm, a fewer number of parts is required. Especially, in a solenoid pump in which a fine amount of fluid is made to flow in and out, because the diaphragm itself also is small, assembly of the apparatus can be simplified by having the engagement portion formed integrally with the diaphragm.

Preferably, a displacement amount adjustment mechanism, for adjusting a displacement amount over which the movable member is displaced, is disposed at a position confronting a rear end position of the movable member.

By adjusting the displacement amount of the movable member by means of the displacement amount adjustment mechanism, the volume of the pump chamber, which is formed by the movable member and the housing, can easily be adjusted. Consequently, the fluid that flows into and out from the interior of the solenoid pump can easily be adjusted to an amount required by the user.

In this case, the displacement amount adjustment mechanism may be constituted by a fixed member in which internal adjustment threads are formed along a direction of displacement of the movable member, and an adjustment bolt screw-engaged with the internal adjustment threads and which is movable along an axial direction with respect to the fixed member. An end of the adjustment bolt on a side of the movable member may project from the fixed member, in a state in which the adjustment bolt is moved maximally toward the side of the movable member. In this manner, because displacement of the end portion of the adjustment bolt on the side of the movable member can be adjusted merely by moving the adjustment bolt in an axial direction with respect to the fixed member, the displacement amount adjustment mechanism is capable of adjusting more easily and reliably the displacement amount of the movable member.

According to the present invention, a communication state of a fluid passage through which a fluid flows can easily be switched, such that the amount of fluid flowing through the fluid passage can be controlled with high precision. In addition, deterioration of the fluid in the interior of the fluid passage can be prevented, the amount of fluid that flows out from the outlet side passage can be kept stable, and the durability of the diaphragm can be enhanced.

The above and other objects, features and advantages of the present invention will become more apparent from the following description when taken in conjunction with the accompanying drawings in which a preferred embodiment of the present invention is shown by way of illustrative example.

DETAILED DESCRIPTION OF THE PREFERRED EMBODIMENTS

Below, explanations shall be given in detail with reference to the accompanying drawings of preferred embodiments (first and second embodiments) of a solenoid pump according to the present invention. As already discussed above, the solenoid pumps according to the first and second embodiments are constituted by fluid passages of a fluid supply apparatus for controlling the supply of liquids in fine amounts, such that such fine amounts of liquid are made to flow into and be discharged from the solenoid pump. However, the present invention is not limited to such features. For example, air may also be applied as the fluid that flows through the interior of the solenoid pump. Further, a structure may be provided in which a comparatively large amount of fluid is made to flow through the solenoid pump. In the following explanations, for facilitating understanding of the invention, unless indicated otherwise, upper, lower, left and right directions shall be described with reference to the arrow directions shown in FIG. 1 as a standard.

Figure 1:
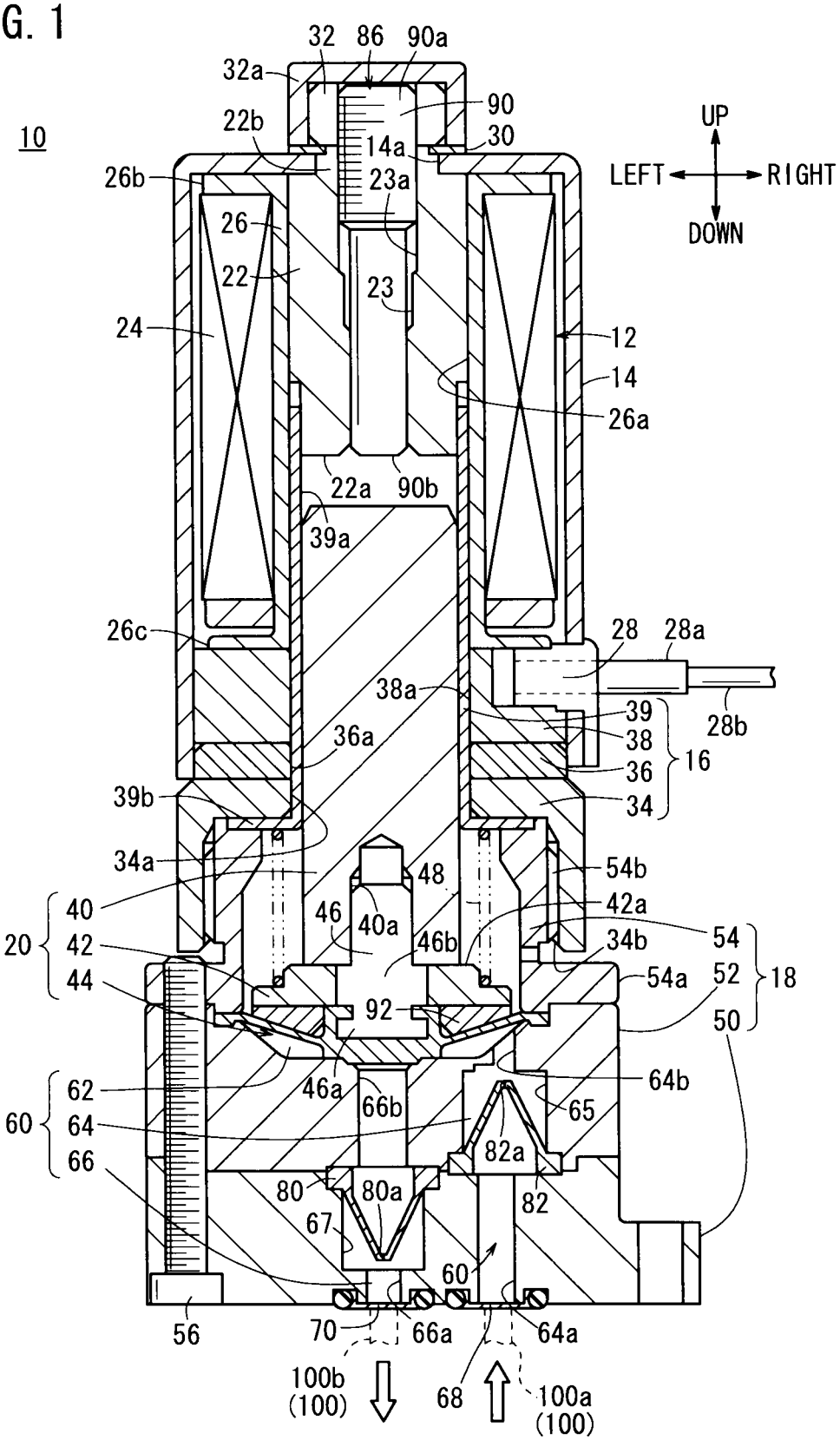
FIG. 1 is a lateral cross sectional view showing interior structural details, in a normal condition in which electric current is not supplied to a solenoid section, in the solenoid pump according to a first embodiment of the present invention.

FIG. 1 is a lateral cross sectional view showing internal structural details of a solenoid pump 10 according to a first embodiment of the present invention, in a normal condition in which electrical power is not supplied to a solenoid section 12. As shown in FIG. 1, the exterior appearance of the solenoid pump 10 according to the first embodiment is constituted by a case 14, an intermediate connecting section 16, and a housing 18. In the interior thereof, there are accommodated the solenoid section 12, a movable member 20, etc.

The case 14 is formed, for example, from a metal material having a bottomed cylindrical shape. The solenoid section 12 is installed in the case 14 from above and covered thereby. In an upper central portion of the case 14, a hole 14*a* is formed into which an attachment section 22*b* of a later described fixed iron core 22 is press-inserted.

The solenoid section 12, which is arranged in the interior of the case 14, includes a bobbin 26 on which a coil 24 is wound, the fixed iron core (fixed member) 22 that is press-inserted in an axial center portion of the bobbin 26, and an electrical power source contact member 28, which is connected electrically to the coil 24. The bobbin 26 has a cylindrical shape, and comprises an insertion hole 26*a* therein, which penetrates through the bobbin 26 in an axial direction. On upper and lower ends of the bobbin, two (a pair of) respective flanges 26*b*, 26*c* are formed, which are expanded in diameter radially outward. The coil 24 is wound and retained between the pair of flanges 26*b*, 26*c*.

The fixed iron core 22 is formed in a roughly circular columnar shape from a metal material. The side periphery of the fixed iron core 22 has an outside diameter substantially matching the diameter of the insertion hole 26*a* of the bobbin 26, whereby the fixed iron core 22 is fitted into the bobbin 26 by press-insertion thereof into the insertion hole 26*a*. Further, a receiving member 22*a*, a side peripheral surface of which is reduced in diameter radially inward, is formed on a lower portion of the fixed iron core 22. In the same manner, the attachment section 22*b*, a side peripheral surface of which is reduced in diameter radially inward, is formed on the upper portion of the fixed iron core 22. Still further, a bolt insertion hole 23 is formed to penetrate through the axial center of the fixed iron core 22, with internal (female) threads 23*a* being formed (i.e., engraved) along an upper portion of the bolt insertion hole 23.

An adjustment bolt 90 is inserted into the bolt insertion hole 23, such that male threads 90*a*, which are formed on a head part of the adjustment bolt 90, are screw-engaged with the internal threads 23*a*. Further, a fixing nut 32 is screw-engaged on an upper part of the male threads 90*a*. Before the fixing nut 32 is screw-engaged on the male threads 90*a*, the case 14 is attached via the hole 14*a* onto the attachment section 22*b* of the fixed iron core 22, and a ring-shaped washer 30 having an outside diameter larger than that of the hole 14*a* is fitted thereon. Owing thereto, the fixed iron core 22 and the washer 30 sandwich the case 14 therebetween, so that the case 14 becomes fixed firmly to the attachment section 22*b* of the fixed iron core 22. A nut cover 32*a* is disposed so as to cover the fixing nut 32.

The electrical power source contact member 28 is disposed on a lower part of the bobbin 26 and is connected electrically to the coil 24 that is wound on the bobbin 26. The electrical power source contact member 28 includes a terminal 28*a* that projects from a side surface of the case 14, and the terminal 28*a* is connected via a power cord 28*b* to a non-illustrated external power source. When electrical power from the external power source is supplied to energize the solenoid section 12 via the electrical power source contact member 28, the solenoid section 12 is excited based on a change in electrical current that takes place therein.

Further, the intermediate connecting section 16 of the solenoid pump 10 is constituted by three sleeves (first sleeve 34, second sleeve 36, third sleeve 38), and a guide member 39, which is inserted through holes 34*a*, 36*a*, 38*a* of the three sleeves, and is inserted into the insertion hole 26*a* of the bobbin 26. The first sleeve 34 is formed in the shape of a bottomed cylinder, having a hole 34*a* bored in an upper and center portion thereof, which substantially matches the inner diameter of the insertion hole 26*a* of the bobbin 26. Furthermore, internal (female) threads 34*b* are formed on an inner peripheral surface of the first sleeve 34. The housing 18 is screw-engaged from a lower side with the internal threads 34*b* when the solenoid pump 10 is assembled.

The second sleeve 36 comprises a ring shaped member arranged on an upper portion of the first sleeve 34, having the hole 36*a* of the same diameter as the hole 34*a* of the first sleeve 34 formed in a center portion thereof.

The third sleeve 38 comprises a ring-shaped member arranged on an upper portion of the second sleeve 36, which similar to the first and second sleeves 34, 36, has the hole 38*a* of the same diameter as the holes 34*a*, 36*a* formed in a center portion thereof. A portion on the outer peripheral surface of the third sleeve 38 is cut out for enabling the electrical power source contact member 28 to be accommodated therein. The electrical power source contact member 28 is retained by being gripped between the third sleeve 38 and the flange 26*c* of the bobbin 26.

The guide member 39 is formed in a cylindrical shape having an outer diameter, which substantially matches the inner diameters of the holes 34*a*, 36*a*, 38*a* and the insertion hole 26*a*. On the center axis of the guide member 39, a guide hole 39*a* is formed that extends in the axial direction. Further, a flange 39*b* that extends in a radial outward direction is formed on the lower part of the guide member 39. Together with screw-engagement of the first sleeve 34 and the housing 18, the flange 39*b* of the guide member 39 becomes sandwiched and gripped between a top (ceiling) surface of the first sleeve 34 and the upper surface of the housing 18. As a result, the cylindrical portion of the guide member 39 is arranged in an upstanding manner from the hole 34*a* of the first sleeve 34. Additionally, the second and third sleeves 36, 38 and the bobbin 26 are fitted successively on the outer peripheral surface of the cylindrical portion of the guide member 39. Furthermore, the receiving member 22*a* of the fixed iron core 22 is fitted into the upper part of the guide hole 39*a*, and the guide member 39 and the fixed iron core 22 are connected by welding at the interfitted location therebetween.

More specifically, in the solenoid pump 10, the axial center positions of each of the constituent elements arranged on the upper side from the intermediate connecting section 16 are arranged coaxially (with the exception of the electrical power source contact member 28) via the guide member 39. Further, a structure is provided in which each of the upper side constituent elements of the solenoid pump 10 are retained together integrally by the intermediate connecting section 16 and the fixed iron core 22, and such constituent elements are connected to the housing 18 at the lower portion of the solenoid pump 10.

The movable member 20 of the solenoid pump 10 includes a plunger 40, a flange member 42, and a diaphragm 44, etc., which are arranged displaceably in the interior of the solenoid pump 10. The plunger 40 is formed, for example, in a substantially circular columnar shape from a magnetic material such as iron or the like. Further, the plunger 40 is formed to have an outer diameter which is capable of being displaced vertically up and down in the interior of the guide hole 39*a* of the guide member 39, such that by being inserted into the guide hole 39*a*, the plunger 40 is arranged coaxially with the fixed iron core 22, which is positioned upwardly therefrom. By excitation of the solenoid section 12, a thrust force is imposed, which draws the plunger 40 (in an upward direction) toward the side of the fixed iron core 22, such that the plunger 40 is displaced upwardly.

Further, a screw hole 40*a* is formed on a distal end portion (lower part) of the plunger 40, and an attachment screw 46 is screw-engaged in the screw hole 40*a*. The attachment screw 46 is formed with a shank portion 46*b* that is expanded in diameter radially outward to approach a head portion 46*a* of an intermediate section thereof. The flange member 42 is fitted over the shank portion 46*b*. On the other hand, the diaphragm 44 is attached (i.e., assembled onto) the head portion 46*a* of the attachment screw 46.

The flange member 42 is formed in a circular plate-like shape that is expanded in diameter in a radial outward direction more so than the end surface of the plunger 40. A step 42*a*, which is reduced in diameter in a radial inward direction from the outermost periphery thereof, is formed on the upper surface of the flange member 42, and the lower side end portion of a pressing spring 48 is engaged with the step 42*a*.

An upper side end portion of the pressing spring 48 abuts against the flange 39*b* of the guide member 39, such that the flange member 42, which is engaged with the lower side end portion of the pressing spring 48, normally is urged in a downward direction. As a result of the flange member 42 being pressed by the pressing spring 48, the movable member 20 is pressed in a downward direction integrally therewith.

Figure 3:
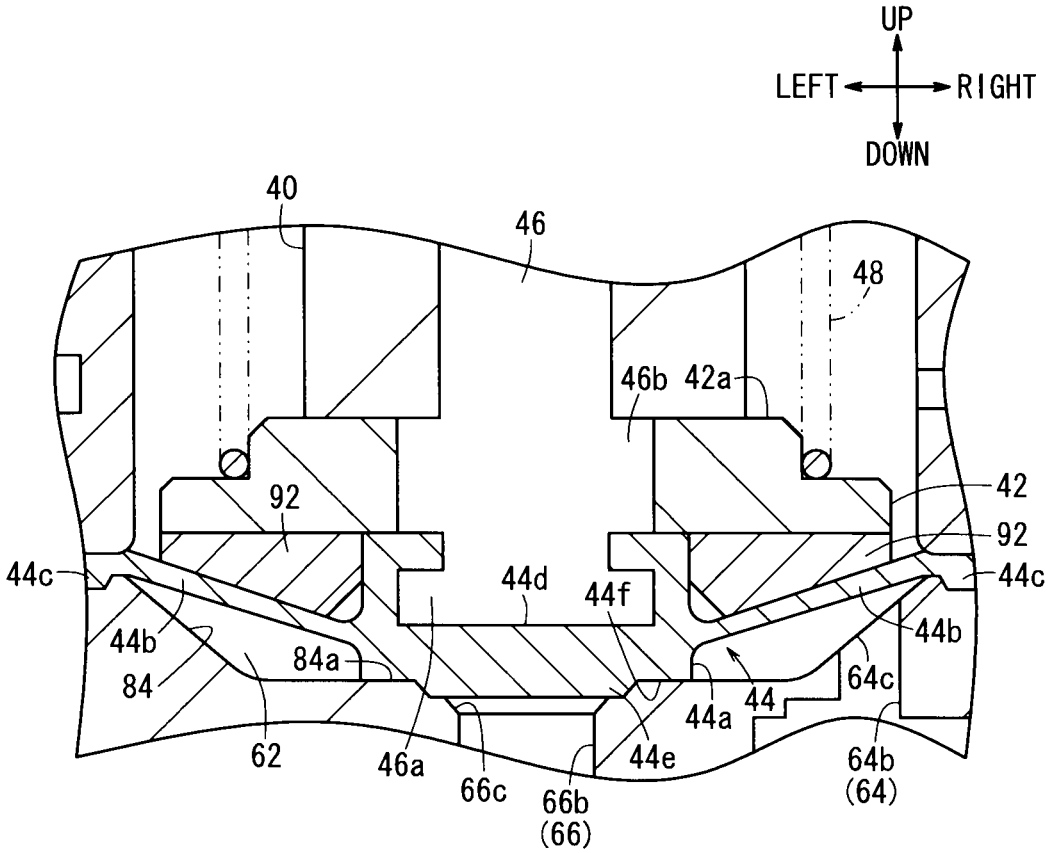
FIG. 3 is an enlarged lateral cross sectional view showing the vicinity of a pump chamber of the solenoid pump of FIG. 1.

The diaphragm 44 is formed, for example, from an elastic material such as rubber or the like, and as shown in FIG. 3, includes a center portion 44*a*, which is comparatively thick walled, a membrane portion 44*b* connected with the center portion 44*a* and expanded in diameter radially outward therefrom, and an outer peripheral edge portion 44*c* connected with the membrane portion 44*b* and which is fixed to the housing 18. On an upper surface of the center portion 44*a* of the diaphragm 44, an attachment hole 44*d* having a hook therein is formed. The head portion 46*a* of the attachment screw 46 is inserted into the attachment hole 44*d* of the diaphragm 44 and is engaged by the hook. In an attached state with the plunger 40, the diaphragm 44 is constructed such that the center portion 44*a* thereof, on a side opposite from the end of the plunger 40, and the lower surface of the membrane portion 44*b* face toward the housing 18. Further, the flange member 42 is retained reliably as a result of being inserted and sandwiched between the attachment portion of the diaphragm 44 and the end surface of the plunger 40.

Returning to FIG. 1, the housing 18 of the solenoid pump 10 is made up from three block bodies (a first block 50, a second block 52, and a third block 54), the first through third blocks 50, 52, 54 being stacked in this order from a lower side, the blocks being connected and constructed together integrally by means of a connecting screw 56. Further, a fluid passage 60 through which a fluid is capable of passing is formed in the housing 18, the fluid passage 60 including a pump chamber 62, an inlet side passage 64, and an outlet side passage 66.

The first block 50 forms a member that is connected to a fluid passage 100 of a liquid supply device (not shown). On the lower side end surface thereof, which is connected to the fluid passage 100, an inlet port 68 and an outlet port 70 are formed respectively. The inlet port 68 is connected to an upstream side fluid passage 100*a* for allowing a liquid to be introduced into the interior of the solenoid pump 10, whereas the outlet port 70 is connected to a downstream side fluid passage 100*b* and functions to discharge the liquid from the interior of the solenoid pump 10.

In the interior of the first block 50, there are bored therethrough a first inlet side passage 64*a* that penetrates from the inlet port 68 to the upper side surface on the opposite side, a first outlet side passage 66*a* that penetrates from the outlet port 70 to the upper side end surface. A first accommodating portion 67, the interior diameter of which is greater than the first outlet side passage 66*a*, is formed on an upper side of the first outlet side passage 66*a*. An outlet side check valve 80 is accommodated in the first accommodating portion 67 when the housing 18 is assembled. The outlet side check valve 80 is accommodated therein so that a valve tip part 80*a* thereof faces toward the outlet port 70 from the pump chamber 62. When liquid flows into the solenoid pump 10, the valve tip part 80*a* blocks flow of liquid from the outlet side passage 66 by closing the outlet side check valve 80, while allowing liquid to flow out by opening the outlet side check valve 80 when the liquid is being discharged.

The second block 52 forms a member disposed between the first block 50 and the third block 54. In the interior of the second block 52, there are bored therethrough a second inlet side passage 64*b* that penetrates to the first inlet side passage 64*a*, and a second outlet side passage 66*b* that penetrates to the first outlet side passage 66*a*. The second inlet side passage 64*b* and the second outlet side passage 66*b* are formed so as to penetrate from a lower surface end side, which is connected to the first block 50, to an opposite upper surface end side. A second accommodating portion 65, the interior diameter of which is greater than the second inlet side passage 64*b*, is formed on a lower side of the second inlet side passage 64*b*. An inlet side check valve 82 is accommodated in the second accommodating portion 65 when the housing 18 is assembled. The inlet side check valve 82 is accommodated therein so that a valve tip part 82*a* thereof faces toward the pump chamber 62 from the inlet port 68. When liquid flows into the solenoid pump 10, the valve tip part 82*a* allows flow of liquid from the inlet side passage 64 by opening the inlet side check valve 82, while blocking outward flow of the liquid by closing the inlet side check valve 82 when liquid is discharged.

Further, as shown in FIG. 3, a recess 84, the center portion of which is sunken with respect to the side portion thereof, is formed on an upper side end surface of the second block 52, the recess 84 confronting a lower surface of the diaphragm 44. The recess 84 is formed in a tapered shape, such that the side surface thereof expands in diameter toward the third block 54, and the bottom surface thereof is formed in a flat shape as a fixed wall 84*a* that is capable of abutment with the diaphragm 44. Further, an opening 64*c* of the second inlet side passage 64*b* is formed at a predetermined location (on the right side as shown in FIG. 3) on the side surface of the recess 84, and an opening 66*c* of the second outlet side passage 66*b* is formed in a central portion of the fixed wall 84*a*.

As shown in FIG. 1, a space surrounded by the recess 84 and the diaphragm 44 is formed as the pump chamber 62 of the fluid passage 60. More specifically, the pump chamber 62 communicates with the inlet side passage 64 (the first and second inlet side passages 64*a*, 64*b*) and the outlet side passage 66 (the first and second outlet side passages 66*a*, 66*b*), and functions such that liquid flows therein from the inlet side passage 64 and is discharged (flows out) into the outlet side passage 66.

The third block 54 is formed in a cylindrical shape having a projecting edge portion 54*a* that projects radially outward on a lower side thereof, and a distal end of the movable member 20 is inserted inside the cylinder. The lower side end surface of the projecting edge portion 54*a* is connected to a side portion of the upper side end surface of the second block 52. When the second block 52 and the third block 54 are connected, the projecting edge portion 54*a*, in cooperation with a side portion of the upper side end surface of the second block 52, sandwiches the outer peripheral edge portion 44*c* of the diaphragm 44 therebetween. Owing thereto, the outer peripheral edge portion 44*c* of the diaphragm 44 is fixed to the housing 18. Further, male threads 54*b* are formed on the outer peripheral surface of the third block 54. Connection between the housing 18 and the intermediate connecting section 16 is accomplished by screw-engagement of the male threads 54*b* with the internal threads 34*b* of the first sleeve 34.

The solenoid pump 10 according to the first embodiment is constructed basically as described above. Next, operations and effects of the solenoid pump 10 shall be described below with reference to FIGS. 1 through 4.

In the solenoid pump 10, by excitation of the solenoid section 12, the movable member 20 arranged therein is displaced, thereby opening and closing the fluid passage 60. More specifically, in an unexcited state in which the solenoid section 12 is not excited, the movable member 20 is positioned on the lower side of the guide hole 39*a* in the interior of the solenoid pump 10, whereby communication between the pump chamber 62 and the outlet side passage 66 is blocked. Additionally, in an excited state in which electrical power is supplied to the solenoid section 12 from an external power source, the movable member 20 is attracted and is displaced toward the upper side of the guide hole 39*a*, whereby communication between the pump chamber 62 and the outlet side passage 66 is opened.

As shown in FIG. 1, in a non-excited condition, the diaphragm 44 of the solenoid pump 10, which is attached to the distal end side of the movable member 20, is pressed by the pressing spring 48 (downwardly) from the interior of the pump chamber 62 toward the side of the outlet side passage 66. In this case, the lower surface side of the center portion 44*a* of the diaphragm 44 abuts against the center of the recess 84 of the second block 52.

As shown in FIG. 3, the opening 66*c* of the outlet side passage 66 is formed in a tapered shape in the center of the recess 84, and further, the fixed wall 84*a*, which is formed in a flat shape surrounding the opening 66*c*, is formed on the periphery of the recess 84. On the other hand, a projection 44*e*, which confronts the opening 66*c* of the outlet side passage 66, is formed in a central position on the lower surface of the center portion 44*a* of the diaphragm 44. The side peripheral part of the projection 44*e* is formed in a tapered shape, which is reduced in diameter toward the opening 66*c*. Further, the diaphragm 44 is formed with a flat abutment 44*f* that surrounds the periphery of the projection 44*e*, the abutment 44*f* facing toward and confronting the fixed wall 84*a*. Accordingly, when the fluid passage 60 is placed in a blocked condition by the diaphragm 44, the fixed wall 84*a* and the abutment 44*f*, both of which are formed in a flat shape, are placed in intimate contact with each other, and communication between the pump chamber 62 and the outlet side passage 66 can be reliably blocked (obstructed). Furthermore, in the blocked state of the fluid passage 60, the tapered shape of the opening 66*c* of the outlet side passage 66 and the tapered shape of the projection 44*e* are placed in intimate contact, and because the projection 44*e* tightly seals the opening 66*c*, communication between the pump chamber 62 and the outlet side passage 66 can be even more reliably blocked.

Figure 2:
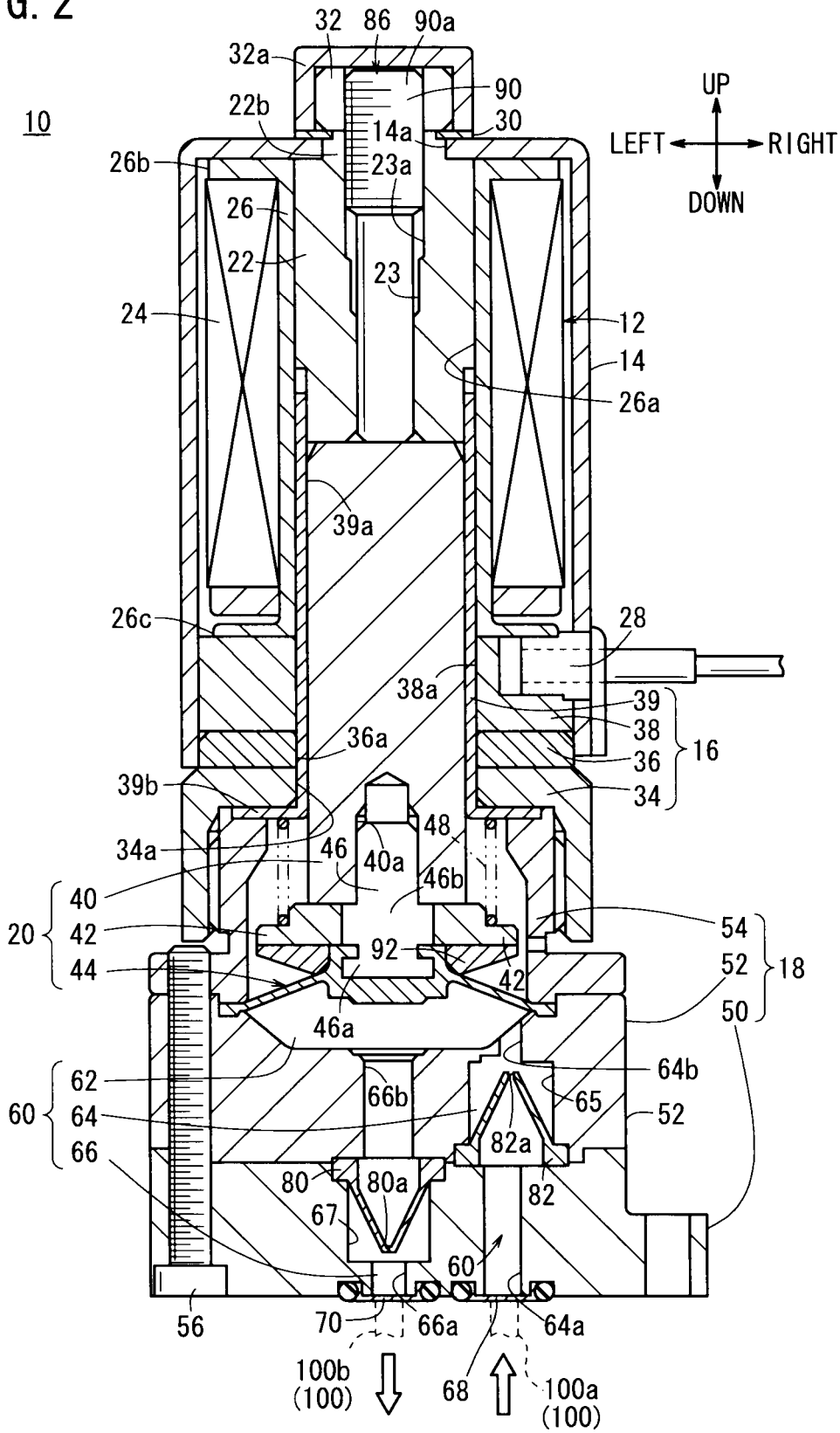
FIG. 2 is a lateral cross sectional view showing internal structural details in an excited state of the solenoid section, in the solenoid pump according to the first embodiment.

As shown in FIG. 2, when the solenoid section 12 of the solenoid pump 10 is switched to an excited state (i.e., when electrical power is supplied thereto), the movable member 20 is disposed toward the upper side inside the guide hole 39*a*, and the rear end portion of the plunger 40 abuts against the receiving member 22*a* of the fixed iron core 22, or abuts against a later described distal end portion 90*b* of the adjustment bolt 90. In addition, accompanying displacement of the movable member 20, the diaphragm 44, which is attached to the distal end thereof, releases (opens) the blocked state of the pump chamber 62 and the outlet side passage 66. When the movable member 20 is displaced, as a result of the plunger 40 being guided by the guide hole 39*a*, the movable member 20 can be displaced in an upward direction with high precision.

Figure 4:
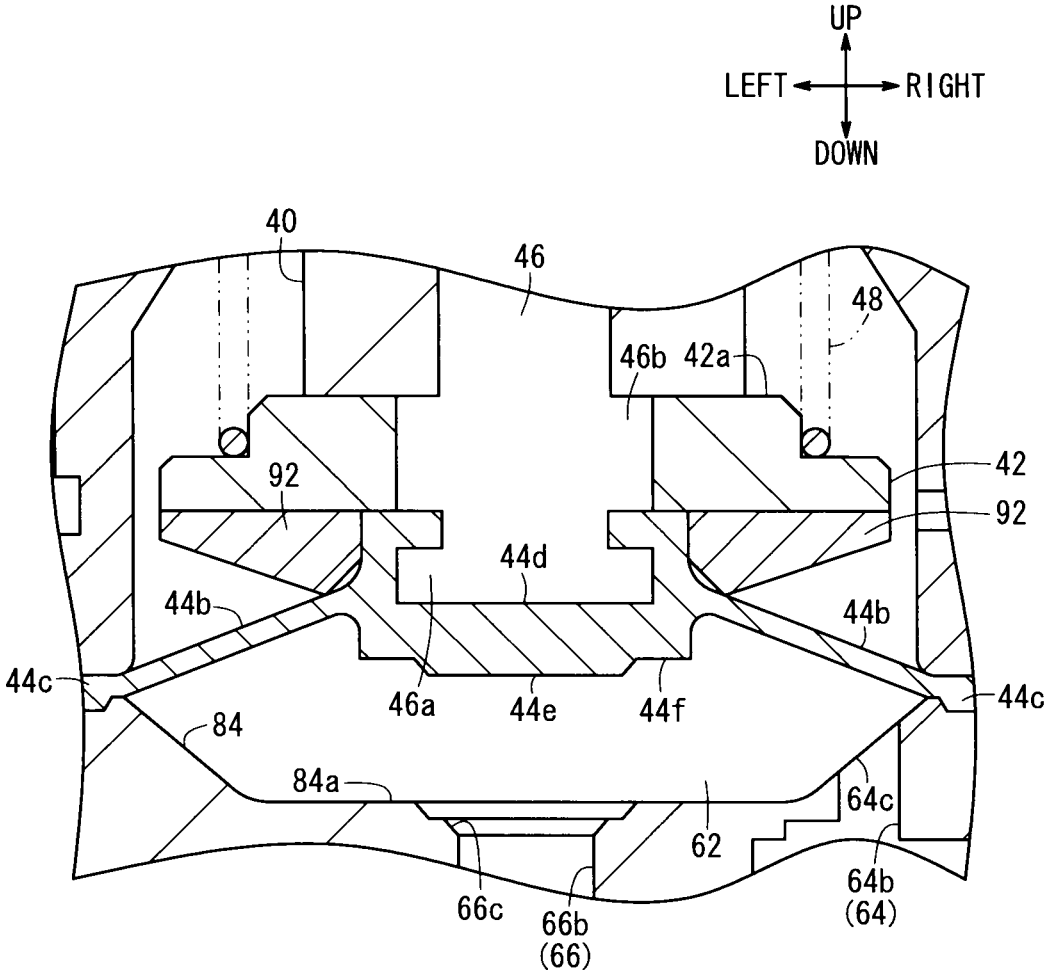
FIG. 4 is an enlarged lateral cross sectional view showing the vicinity of the pump chamber of the solenoid pump of FIG. 2.

As shown in FIG. 4, accompanying displacement of the movable member 20, on the diaphragm 44, the outer peripheral edge portion 44*c* of which is fixed to the housing 18, the center portion 44*a* and the membrane portion 44*b* of the diaphragm 44 are displaced upwardly and deformed, whereby the volume (cubic volume of the space) of the pump chamber 62 is made larger. Owing thereto, liquid is drawn into the pump chamber 62 and can be caused to flow into the chamber interior. As shown in FIG. 2, on the inlet side check valve 82, which is arranged in the inlet side passage 64, the valve tip part 82*a* thereof opens accompanying the suction action of fluid into the pump chamber 62, and liquid flows into the pump chamber 62 from the side of the inlet port 68. On the other hand, the valve tip part 80*a* of the outlet side check valve 80, which is arranged in the outlet side passage 66, is maintained in a closed state while liquid is being drawn into the pump chamber 62, such that liquid is blocked from flowing into the pump chamber 62 from the outlet side passage 66. Accordingly, flowing of liquid into the interior of the pump chamber 62 from the outlet side passage 66 is prevented, while flow of liquid into the interior of the pump chamber 62 from the inlet side passage 64 is allowed.

In a state in which the movable member 20 is displaced toward the upper side inside the guide hole 39*a*, a predetermined amount of liquid flows into the pump chamber 62. More specifically, in the solenoid pump 10, by changing the upper side displacement position of the movable member 20, the displacement amount of the movable member 20 can be adjusted, and accordingly, the amount of fluid that flows into and is discharged out from the pump chamber 62 can also be adjusted. To enable this function, in the solenoid pump 10 according to the present embodiment, a displacement amount adjustment mechanism 86 is provided, which is cable of adjusting the displacement amount of the movable member 20.

As shown in FIG. 1, the displacement amount adjustment mechanism 86 is constituted by the fixed iron core 22, which is disposed in a position confronting the rear end portion of the movable member 20 (plunger 40), and the adjustment bolt 90. In greater detail, the bolt insertion hole 23 of the fixed iron core 22 is formed along the direction of displacement of the movable member 20, and male threads 90*a* of the adjustment bolt 90 are screw engaged with internal threads (internal adjustment threads) 23*a* of the bolt insertion hole 23. The adjustment bolt 90 is constituted such that, accompanying rotation thereof with respect to the fixed iron core 22, the adjustment bolt 90 can be moved in upward and downward directions, and in a condition where the adjustment bolt 90 is moved maximally toward the side of the movable member 20, the end (distal end portion 90*b*) of the adjustment bolt 90 projects outwardly from the fixed iron core 22.

More specifically, the displacement amount adjustment mechanism 86 adjusts the amount by which the distal end portion 90*b* projects from the lower end surface of the fixed iron core 22. In this case, by removing the nut cover 32*a* and screw feeding the adjustment bolt 90 to adjust the position of the distal end portion 90*b*, the upper side displacement position at which the rear end portion of the plunger 40 abuts against the distal end portion 90*b* is adjusted. As a result, the displacement amount of the movable member 20 in the solenoid pump 10 is adjusted, and together therewith, the amount of fluid that is drawn into the pump chamber 62 is adjusted. A buffering member may also be disposed at a location thereon where the movable member 20 abuts against the adjustment bolt 90. Such a buffering member can absorb and buffer shocks that occur upon abutment with the adjustment bolt 90.

When the solenoid pump 10 is switched from an excited state to a non-excited state, as shown in FIG. 3, the movable member 20, which had been displaced to the upper side of the guide hole 39*a*, is pressed by the pressing spring 48 and is displaced downward. Accompanying this motion, the diaphragm 44 also is displaced and deformed downwardly, and the pump chamber 62 becomes smaller in volume. By displacement and deformation of the diaphragm 44, the liquid that has flowed into the interior of the pump chamber 62 is discharged into the outlet side passage 66 from the pump chamber 62. At this time, the valve tip part 80*a* of the outlet side check valve 80 opens upon receipt of a pressing force from the liquid, and allows the liquid to flow out therefrom. On the other hand, the valve tip part 82*a* of the inlet side check valve 82 closes after the liquid is drawn into the pump chamber 62, so that liquid from the pump chamber 62 is blocked from flowing out. Accordingly, liquid that has flowed into the pump chamber 62 flows only into the opening 66*c* of the outlet side passage 66, and is discharged from the outlet side passage 66 to the downstream side fluid passage 100*b* via the outlet port 70. Because in the solenoid pump 10, the opening 66*c* of the outlet side passage 66 is formed in a tapered shape, the liquid can be guided easily into the outlet side passage 66 from the pump chamber 62.

As described above, in the solenoid pump 10 according to the present invention, when the movable member 20 blocks communication between the pump chamber 62 and the outlet side passage 66, outward flow of liquid can be blocked reliably by the movable member 20. Owing thereto, compared to a structure (e.g., the fluid pump of U.S. Pat. No. 5,284,425) in which the movable member 20 merely blocks the inlet side passage 64, when the fluid passage 60 is blocked by the movable member 20, the timing at which outward flow of the liquid is terminated can be made constant, and a desired amount of fluid can be stably discharged.

Further, because the solenoid pump 10 is structured such that the pressing spring 48 presses the flange member 42 disposed on the distal end side of the movable member 20, the pressing force of the pressing spring 48 can be transmitted advantageously also to the diaphragm 44 that is attached to the distal end portion, whereby the fluid passage 60 can be blocked and sealed strongly by the diaphragm 44. More specifically, with a structure similar to that of the fluid pump of U.S. Pat. No. 5,284,425, in which the pressing spring is disposed further behind the rear end portion of the movable member 20, a possibility exists for the movable member 20 to tilt, and thus there is a concern that malfunctioning could occur, in which the fluid passage 60 is not satisfactorily blocked by the movable member 20. In contrast thereto, with the solenoid pump 10 according to the present embodiment, by pressing the flange member 42, which is provided on the front distal end portion of the movable member 20, the aforementioned malfunction can be avoided.

Furthermore, as noted previously, in the solenoid pump 10, because the fixed wall 84*a* is formed in a flat shape and obstacles to flow of the liquid that face toward the outlet side passage 66 do not exist thereon, compared to a structure in which a projection to facilitate sealing is formed surrounding the opening 66*c*, fluid that flows into the pump chamber 62 can smoothly be guided into the outlet side passage 66.

Further, in the solenoid pump 10 according to the present invention, the movable member 20 comprises a support member 92 that supports the membrane portion 44*b* of the diaphragm 44. The support member 92 is formed of an elastic material and is arranged on a side surface of the membrane portion 44*b* opposite from the surface thereof that faces the pump chamber 62. At a time when the fluid passage 60 is blocked, the support member 92 supports the membrane portion 44*b*, and deformation of the membrane portion 44*b* as a result of pressure imposed on the membrane portion 44*b* from the liquid can be avoided. Owing thereto, the amount of liquid that flows out from the pump chamber 62 can be stabilized.

Further, in a blocked condition of the fluid passage 60, a surface (lower surface) of the support member 92 of the present embodiment, which confronts the diaphragm 44, is formed in a tapered shape along an inclination of the opposite side surface of the membrane portion 44*b* of the diaphragm 44, on a side opposite from the pump chamber 62. In this manner, the support member 92 is capable of reliably supporting the membrane portion 44*b* irrespective of large loads applied thereto tending to elastically deform the membrane portion 44*b*.

Furthermore, the support member 92 is formed in an annular shape and is fitted in surrounding fashion to a side peripheral surface on the upper side of the center portion 44*a* of the diaphragm 44, which is attached to the movable member 20. Owing thereto, the support member 92 can provide support across the entire surface of the opposite side of the membrane portion 44*b*, and the membrane portion 44*b* can be supported more reliably. In addition, because the diaphragm 44 and the attachment portion of the attachment screw 46 can be tightened together and secured elastically, detachment or dropping off of the movable member 20 from the diaphragm 44 can be deterred.

In the solenoid pump 10, by providing the support member 92, when the movable member 20 (diaphragm 44) is displaced in a downward direction, warpage on the upper side of the membrane portion 44*b* due to pressure of the liquid that has flowed into the pump chamber 62 can be prevented. Owing thereto, liquid that has flowed into the interior of the pump chamber 62 can reliably be pressed out to the outlet side passage 66 by the diaphragm 44.

In addition, in a state in which the diaphragm 44 blocks communication between the pump chamber 62 and the outlet side passage 66, liquid that resides in the interior of the pump chamber 62 is not exposed to the outlet side passage 66. Consequently, even if the outlet side passage 66 is placed in an opened state, the liquid in the pump chamber 62 does not become deteriorated, and the amount of deteriorated fluid can be reduced. Further, solidification of the liquid caused by such exposure can be suppressed, and the volume of liquid inside the pump chamber 62 can be kept stable. Owing thereto, the solenoid pump 10 can keep the amount of liquid that flows into the pump chamber 62 constant, and is capable of supplying a desired amount of liquid with high precision. Additionally, by suppressing solidification of the liquid, maintenance operations such as cleaning or the like can be performed more easily.

Further, by constructing the diaphragm 44 so as to block communication between the pump chamber 62 and the outlet side passage 66, because the movable member 20 still blocks the outlet side passage 66 even if the membrane portion 44*b* of the diaphragm 44 becomes warped over time, liquid that flows into the pump chamber 62 is not pressed out, and leakage of the liquid can reliably be prevented.

Figure 5:
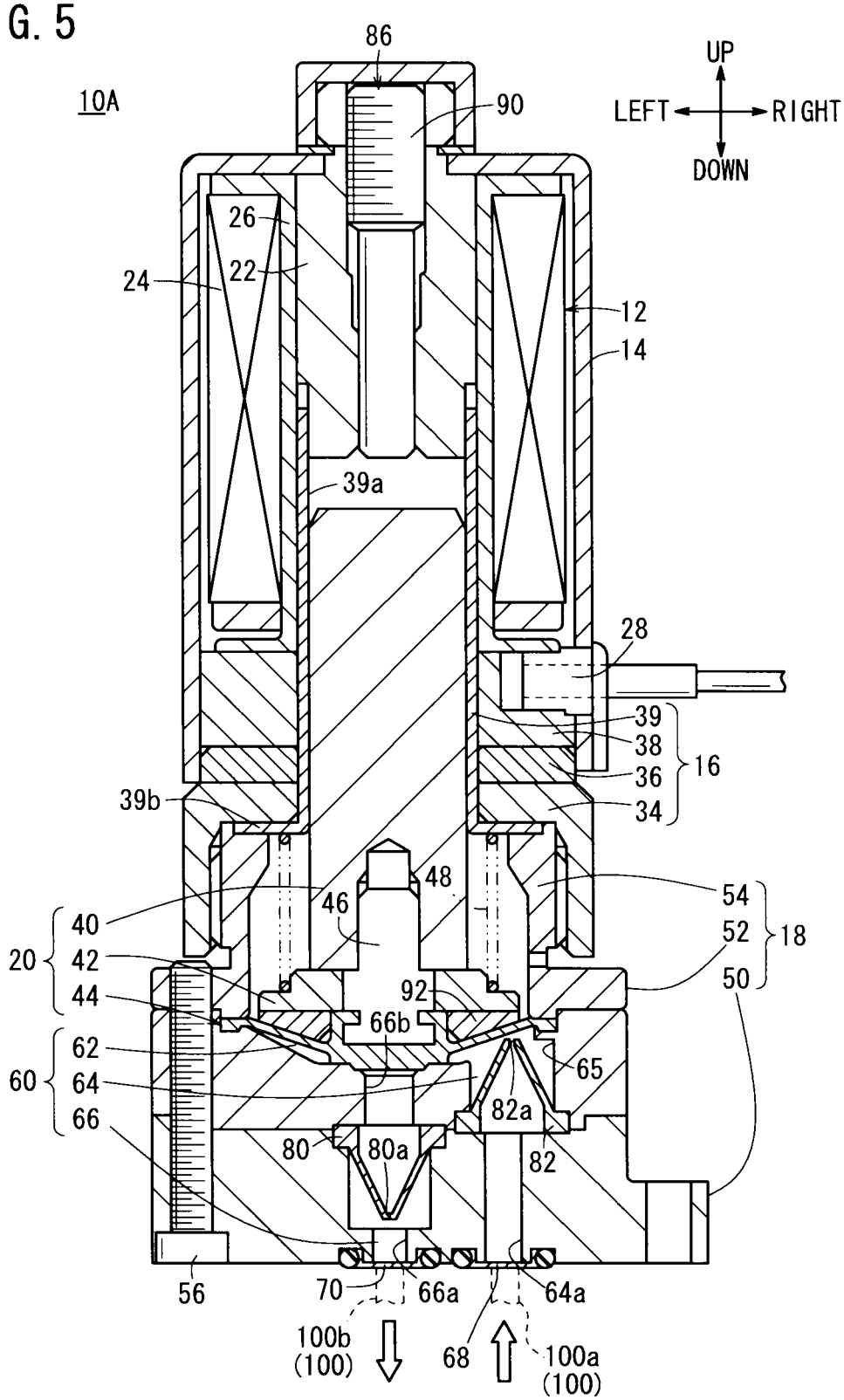
FIG. 5 is a lateral cross sectional view showing a modified example of the solenoid pump according to the first embodiment.

FIG. 5 is a lateral cross sectional view showing a modified example of the solenoid pump 10 according to the first embodiment. As shown in FIG. 5, a solenoid pump 10A according to the modified example differs from the solenoid pump 10 according to the first embodiment, in that a structure is provided in which the valve tip part 82*a* of the inlet side check valve 82, which is accommodated in the inlet side passage 64, projects directly into the pump chamber 62. With this structure as well, because the movable member 20 is capable of opening and closing communication between the pump chamber 62 and the outlet side passage 66, the same effects as those of the first embodiment can be obtained. Further, by means of the solenoid pump 10A according to the modified example, because the second block 52 can be formed smaller, the apparatus can be made smaller in scale.

Figure 6:
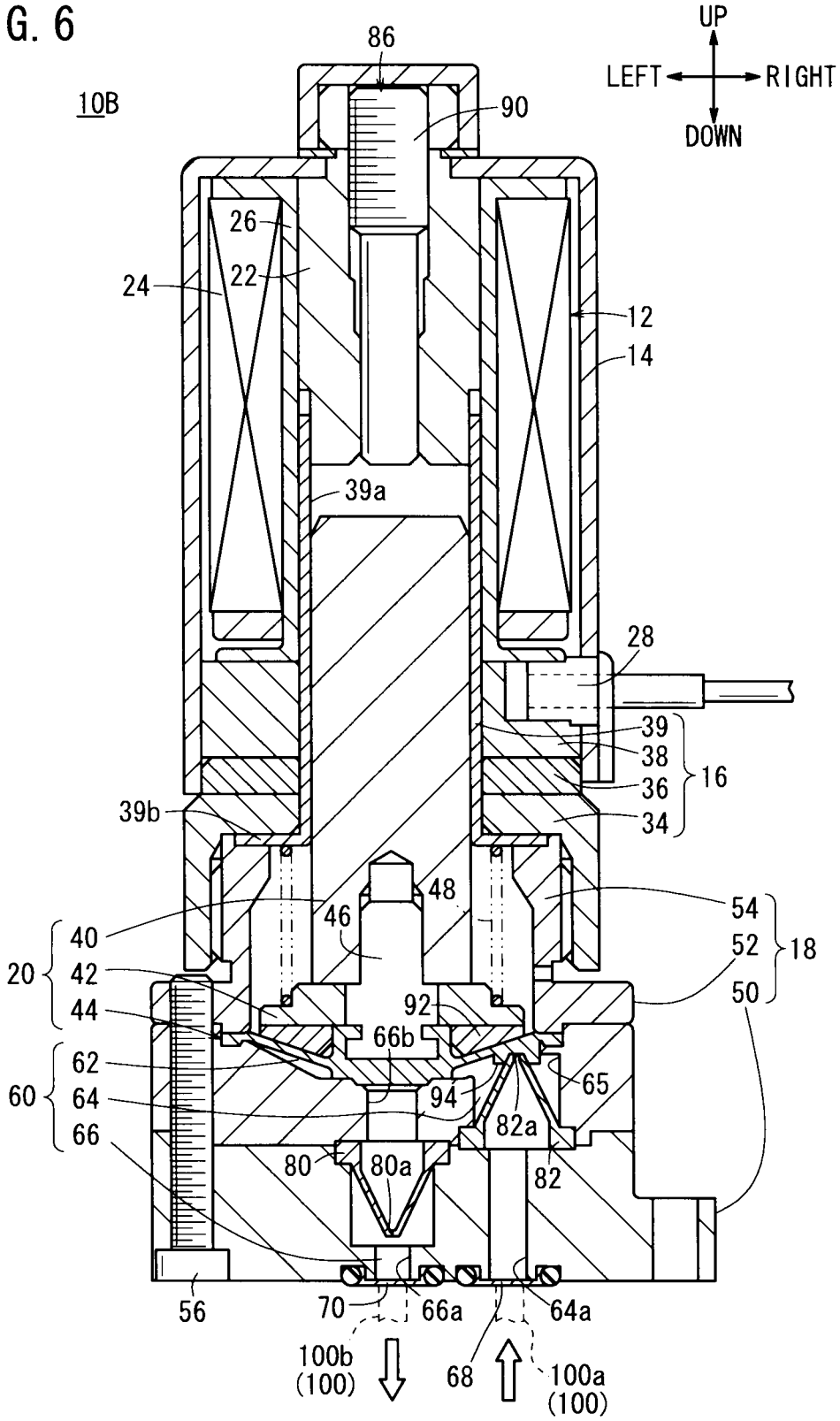
FIG. 6 is a lateral cross sectional view showing internal structural details of a solenoid pump according to a second embodiment of the present invention.

FIG. 6 is a lateral cross sectional view showing internal structural details of a solenoid pump 10B according to a second embodiment of the present invention. The solenoid pump 10B according to the second embodiment differs from the solenoid pump 10 according to the first embodiment, in that the valve tip part 82*a* of the inlet side check valve 82, which is accommodated in the inlet side passage 64, projects directly into the pump chamber 62, and in addition, an engagement portion 94 is provided on the diaphragm 44 at a position confronting the valve tip part 82*a*.

The engagement portion 94 is disposed on the lower surface of the membrane portion 44*b* of the diaphragm 44, such that in a blocked state of the fluid passage 60 by the diaphragm 44, the engagement portion 94 blocks the valve tip part 82*a* of the inlet side check valve 82. In this manner, as a result of the engagement portion 94 blocking the valve tip part 82*a* of the inlet side check valve 82, even in the case of a pressure force, such as a surge pressure or the like of liquid from the inlet side passage 64 into which the liquid flows, inflow of the pressure force in the valve tip part 82*a* of the inlet side check valve 82 can be prevented. As a result, the pressure force does not reach the pump chamber 62 or the diaphragm 44, and therefore, for example, assuming a structure in which the fluid passage 60 is blocked by pressing the movable member 20 using the pressing spring 48, a spring having a small pressing force can be applied. In addition, by application of the spring having the small pressing force, it becomes possible to suppress the force (thrust) needed to cause displacement of the movable member 20 accompanying excitation of the solenoid section 12, whereby the apparatus can be miniaturized by using a small scale solenoid with a small number of coil windings.

Further, the engagement portion 94 is formed integrally with the membrane portion 44*b* of the diaphragm 44. In this manner, by making the engagement portion 94 integral with the diaphragm 44, the number of parts can be reduced. Especially, in the solenoid pump 10B, in which a fine amount of liquid is made to flow in and out, because the diaphragm 44 also is small, assembly of the apparatus can be simplified by having the engagement portion 94 formed integrally with the diaphragm 44.

With the solenoid pumps 10, 10A, 10B according to the present invention, a communication state of the fluid passage 60 through which a fluid flows can easily be switched, such that the amount of fluid flowing through the fluid passage can be controlled with high precision. In addition, deterioration of the fluid in the interior of the fluid passage 60 can be prevented, the amount of fluid that flows out from the outlet side passage 66 can be kept stable, and the durability of the diaphragm 44 can be enhanced. In particular, the solenoid pumps 10, 10A, 10B can suitably be applied to fluid supply apparatus in which fine amounts of fluid are made to flow in and out with high precision.

The solenoid pumps 10, 10A, 10B according to the present invention are not limited to the embodiments (first and second embodiments) described above, but various alternative or additional features and structures may be adopted without deviating from the essence and scope of the invention as set forth in the appended claims.

What is claimed is:

1. A solenoid pump comprising:

a housing formed therein with a fluid passage through which a fluid flows from an inlet port to an outlet port;

a movable member, which is displaced based on an excitation state of a solenoid section, for thereby opening and closing the fluid passage; and a diaphragm provided on an end portion of the movable member, the diaphragm being formed with an abutment that confronts a portion of the housing during a blocked condition of the fluid passage, wherein the fluid passage includes an inlet side passage that communicates with the inlet port, an outlet side passage that communicates with the outlet port, and a pump chamber made up of a space in communication with the inlet side passage and the outlet side passage, and surrounded by the housing and the end portion of the movable member, and wherein the movable member, accompanying displacement thereof, opens and closes communication between the pump chamber and the outlet side passage, wherein an opening of the outlet side passage is formed in a tapered shape expanding in diameter toward the movable member, wherein the diaphragm is formed with a projection, the projection engaging with the tapered shape of the opening of the outlet side passage by inserting therein, thereby sealing the opening of the outlet side passage, wherein the housing is formed by a fixed wall that surrounds the opening of the outlet side passage in communication with the pump chamber, wherein the diaphragm abutment confronts the fixed wall, and an outer peripheral edge portion of the diaphragm being fixed to the housing, and the abutment is placed in intimate contact with the fixed wall during a blocked condition of the fluid passage.

2. The solenoid pump according to claim 1, wherein the fixed wall and the abutment are formed with flat shapes.

3. The solenoid pump according to claim 1, wherein:

the diaphragm includes a membrane portion, which possesses an elastic force, and is connected between the abutment and the outer peripheral edge portion; and the movable member further comprises a support member that supports a surface of the membrane portion on an opposite side from a surface thereof that faces toward the pump chamber.

4. The solenoid pump according to claim 3, wherein, in a condition in which the fluid passage is blocked by the diaphragm, the support member is formed in a tapered shape along an inclination of the opposite side surface.

5. The solenoid pump according to claim 3, wherein:

the diaphragm includes an attachment portion that is attached to the end portion of the movable member; and the support member is formed in an annular shape and is mounted in surrounding fashion to a side peripheral surface of the attachment portion.

6. The solenoid pump according to claim 1, wherein:

a check valve is disposed in the inlet side passage, which enables the fluid to flow from the inlet port into the pump chamber, while blocking flow of the fluid from the pump chamber into the inlet port;

the diaphragm comprises an engagement portion confronting a valve tip part of the check valve; and the valve tip part is blocked by the engagement portion in the condition in which the fluid passage is blocked by the diaphragm.

7. The solenoid pump according to claim 6, wherein the engagement portion is formed integrally with the diaphragm.

8. The solenoid pump according to claim 1, wherein a displacement amount adjustment mechanism, for adjusting a displacement amount over which the movable member is displaced, is disposed at a position confronting a rear end position of the movable member.

9. The solenoid pump according to claim 8, wherein:

the displacement amount adjustment mechanism is constituted by a fixed member in which internal adjustment threads are formed along a direction of displacement of the movable member, and an adjustment bolt screw-engaged with the internal adjustment threads and which is movable along an axial direction with respect to the fixed member; and an end of the adjustment bolt on a side of the movable member projects from the fixed member, in a state in which the adjustment bolt is moved maximally toward the side of the movable member.

* * * * *